United States Patent [19]

Rautenbach et al.

[11] 4,081,914

[45] Apr. 4, 1978

[54] FREEZE DRYER

[76] Inventors: Robert Rautenbach, Turmstr. 46; Horst Hoeck, Kaiser-Friedrich-Allee 2a; Wolfgang Beer, Beeckstr. 38, all of Aachen, Germany, 5100

[21] Appl. No.: 717,556

[22] Filed: Aug. 25, 1976

[30] Foreign Application Priority Data

Aug. 26, 1975 Germany ..... 2537850

[51] Int. Cl.[2] ..... F26B 13/30

[52] U.S. Cl. ..... 34/92

[58] Field of Search ..... 34/5, 92

[56] References Cited

U.S. PATENT DOCUMENTS 3,247,600 4/1966 Togashi et al. ..... 34/92

3,909,957 10/1975 Passey ..... 34/92

*Primary Examiner*—John J. Camby

*Attorney, Agent, or Firm*—Karl F. Ross

[57] ABSTRACT

A freeze dryer for the freeze drying of, for example, comestible products such as fruit juices and coffee, comprises a sublimation chamber having a heating plate upon which the products are disposed and an ice condenser spaced from the heating plate and upon which the moisture driven out of the product sublimes in the form of ice. According to the invention between the heating place and the ice condenser a heat pump is disposed so that the heat transferred to the ice condenser is returned via the heat pump to the heating plate.

6 Claims, 2 Drawing Figures

FREEZE DRYER

FIELD OF THE INVENTION

The present invention relates to a freeze dryer and, more particularly, to a freeze dryer for the freeze drying of comestible products such as juices and fruit pulps, coffee and the like. Specifically, the invention relates to a freeze dryer having a heating plate upon which the material to be freeze dried is temporarily disposed to drive out the moisture and an ice condenser spaced from the heating plate within the sublimation chamber and upon which ice tends to form. The latter may be traversed by a coolant or refrigerant.

BACKGROUND OF THE INVENTION

Freeze dryers of the aforementioned type are known for the drying of coffee and other comestible products and have become highly sophisticated devices designed to freeze dry, more or less continuously or semicontinuously, large quantities of comestible products in a relatively short period.

Freeze drying is based upon the principle that, under vacuum, moisture can be driven from a comestible product by heating the same to a relatively low temperature, below that at which the aesthetic and edible properties of the product are destroyed. For the most part, a conventional freeze dryer comprises a sublimation chamber having a surface upon which the comestible product is heated and an ice condenser upon which the moisture driven from the product condenses in the form of ice, i.e. sublimes from the product into a vapor of the moisture and then condenses directly as ice upon the ice condenser.

The ice condenser is traversed by a coolant or refrigerant and thus must abstract heat from the condensed material equivalent to the sublimation energy supplied to the product on the heating surface.

In the usual freeze dryer of the aforedescribed type the material to be freeze dried is disposed in shells and brought into contact with a heating plate traversed by steam, the moisture being transformed into ice on the ice condenser. The requisite low pressure is produced by a vacuum pump which evacuates the entire sublimation chamber.

Apart from high capital cost for the conventional apparatus, the system is characterized by the relatively high costs for the energy necessary to generate the cold required to freeze the moisture on the ice condenser. The cold costs are especially high when the material to be freeze dried has a comparatively low eutectic temperature (i.e. temperature at which the thawing of the material begins). For example, the juices of citrus fruits have a eutectic temperature of about minus 40° C. With conventional freeze dryers the heating plate temperature must initially, in the case of coffee, be about 100° C and can then drop to levels of about 50° C. The temperature in the ice condenser must, for the freeze drying of coffee, be about minus 40° C. As a consequence the energy required to abstract heat from the cold condenser or supply "cold" thereto is relatively high.

OBJECTS OF THE INVENTION

It is the principal object of the present invention to provide a freezer dryer in which the energy costs for supplying cold to the system can be minimized.

Another object of the invention is to provide an improved freeze dryer which is of low capital cost and high thermal and energy efficiency.

SUMMARY OF THE INVENTION

These objects and others which will become apparent hereinafter are realized in accordance with the invention, in a freeze dryer which, as in conventional systems, comprises one or more heating plates and an ice condenser in a sublimation chamber maintained under vacuum. According to the invention, between the heating plate or heating plates and the ice condenser there is disposed a heat pump which pumps back the heat originally supplied as sublimation heat to the goods treated, from the ice condenser to the heating plates.

This arrangement has the significant advantage that it reduces the cost for cold energy supplied to the system and allows the heat necessary for operation of the heating plates to be at least in part recovered from the ice condenser, the heat being abstracted at the latter from the moisture which is sublimated in the form of ice.

Apart from a substantial reduction in the cold-supply costs, therefore, there is the advantage that a high temperature gradient can be applied between the heating plates and the ice condenser for effective drying. The supply of steam as a heating medium can be eliminated.

Furthermore, it is not necessary to abstract the heat from the ice condenser by special means and, moreover, the system has been found to be especially effective with the freeze drying of materials of extremely low eutectic temperatures.

Advantageously, the system of the present invention makes use of a closed refrigerant cycle operating with a vaporizable and liquefiable refrigerant or coolant. The heat pump can thus be the cycle itself or a portion thereof. Preferably the heat pump comprises a compressor, an absorption cooling machine, a cold heat exchanger and a warm heat exchanger, the ice condenser forming the cold heat exchanger and the heating plate forming the warm heat exchanger of the system.

According to another feature of the invention the liquefied refrigerant is caused to evaporate in the ice condenser, the latter thereby being the evaporator of the refrigerant cycle. The vaporized refrigerant or coolant is compressed in the compressor and is introduced into the heating plates which serve as condensor for the refrigerant and thereby extract heat therefrom, transferring this heat to the material to be treated.

Preferably a small portion of the compressed coolant is fed to the absorption cooling machine (chapter 12, pages 10 ff., PERRY's CHEMICAL ENGINEERS' HANDBOOK, McGraw-Hill Book Company, 1963) and the liquefied coolant from the absorption cooling machine is returned to the refrigerant cycle.

While the ice condenser according to the present invention can be operated in accordance with conventional techniques to thaw ice which deposits thereon, an interruption in the operating process is often undesirable.

In this case this invention provides that the freeze dryer is operated continuously and the ice is removed from the ice condenser during operation of the freeze dryer without interruption of the freeze drying process.

According to the invention, the ice condenser is provided with a device for the thermal release of the deposited ice which can remain effective and be used even during the freeze drying process and without interrupting same.

According to the invention the ice which is released from the ice condenser by providing the latter with a heatable layer which can be heated by a momentaneous process. Thus, the invention provides that the ice condenser be formed with a heating layer which is interposed between the cooling surface and the deposited ice and which can be heated for brief periods to cause the ice at the interface with the heating layer to thaw and release the ice from the ice condenser.

Advantageously, this heating layer is separated by a thin layer of electrical insulation from the ice condenser which is traversed by the coolant. Preferably the heating layer is an ohmic resistor which is heated by passing, for a brief period, an electric current therethrough.

The ice condenser is advantageously a plate heat exchanger provided upon its ice-receiving surface with a metal foil or a galvanically deposited or vapor deposited metal layer, after having been first coated with an electrical insulation which has little thermal insulating effect. An electric current can be passed through this foil or metal layer to release the ice from the ice condenser and cause the same to fall through the gates and be removed from the sublimation chamber.

According to the invention, therefore, the ice layer upon the ice condenser is not fully melted or thawed by the removal process and drops in pieces or as an entire layer through the gate provided therefor.

Only the interfacial portion of the deposited ice layer is thereby melted and a minimal amount of heat is introduced into the system by the thawing electric current.

The heating layer can be heated by a current pulse of a current intensity and duration only sufficient to liquefy the surface layer of the ice deposit upon the ice condenser.

This heating effect can be carried out without interruption of the flow of coolant through the remainder of the plate heat exchanger forming the ice condenser.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
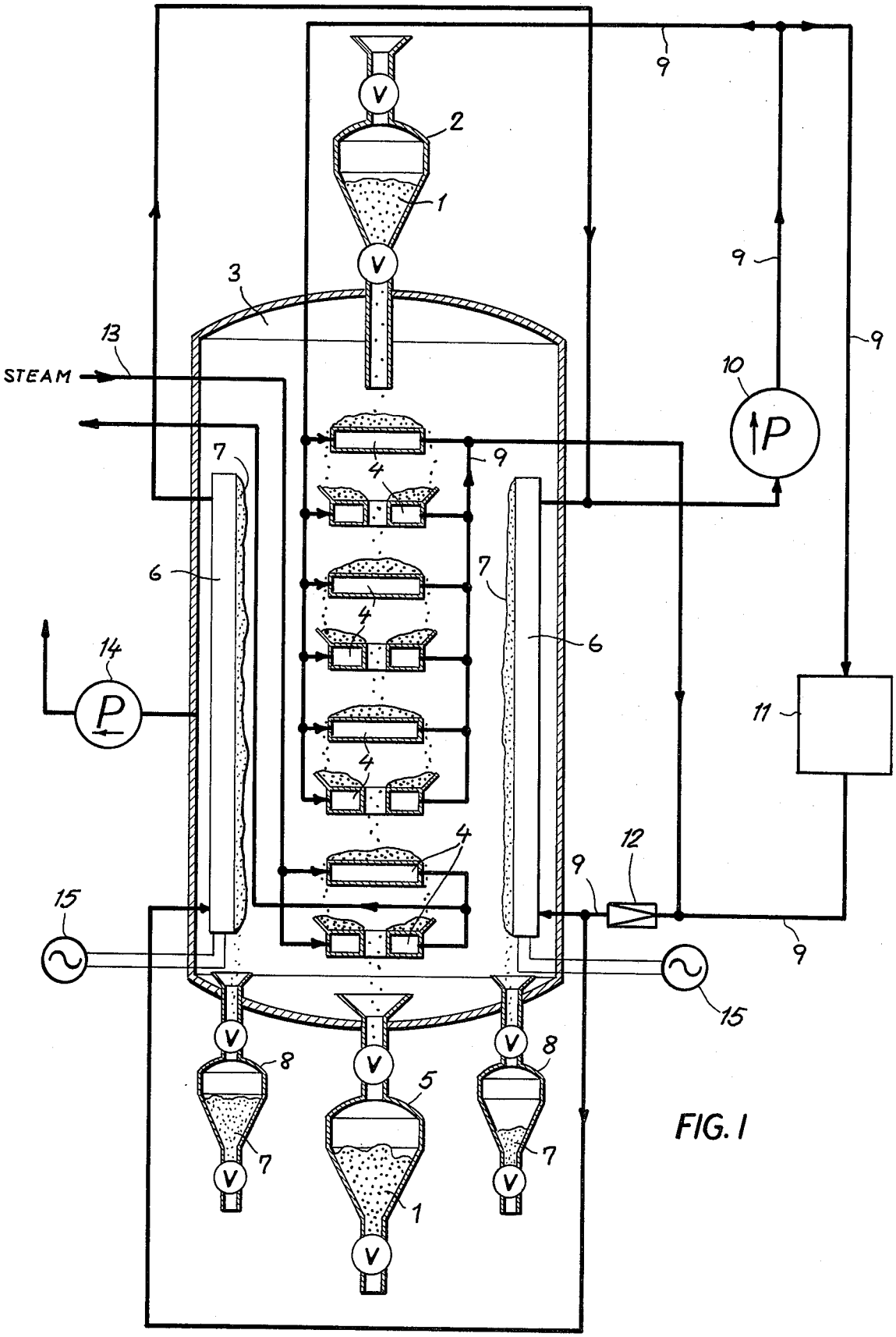
FIG. 1 is a schematic diagram of a freeze-dryer according to the invention as seen in vertical longitudinal cross section.

The freeze dryer shown in FIG. 1 comprises an inlet gate 2 for introducing the material 1 to be subjected to freeze drying into the sublimation chamber 3. The respective heating plates 4 disposed in the sublimation chamber below the gate and the gate itself may be vibrated to continuously feed the material to be treated downwardly through the system. As will be apparent from the drawing, the gates are alternately provided with aprons and central apertures through which the material to be treated passes and without apertures so that the material falls or cascades off the outer edges of each plate onto the aprons of the next lower plate to pass through the central openings thereof and then onto a plate without a central opening to repeat the downward movement of the material to be treated.

At the bottom of the sublimation chamber, the material passes through a gate 5 through which the freeze dried material can be removed periodically or continuously without interrupting the vacuum in the vertically elongated sublimation chamber 3.

Proximal to, but not in contact with, the heating plates 4 are ice condensers 6 which are disposed in the sublimation chamber 3 and have the configuration of plate heat exchangers. The sublimed water vapor deposits in the form of ice in layers 7 upon the ice condensers 6. The ice 7 is removed from time to time, preferably by electrically heating the ice condensers 6 while the latter are continuously traversed by the refrigerant. The ice cascades into gate 8 and is removed from the sublimation chamber without interrupting the vacuum.

A liquid refrigerant or coolant, preferably ammonia, is fed through the ice condensers 6 and is evaporated at low temperatures therein. The evaporated refrigerant 9 is then passed through a compressor 10 in which it is compressed. A small portion of the compressed coolant 9, in order to maintain an effective heat balance, is introduced into the absorber of an absorption cooling machine 11. The greater part of the compressed coolant however is passed through the heating plates 4 where it condenses and released its heat of condensation. The heat of condensation of the condensing coolant 9, together with a liquefied coolant 9 derived from the absorption cooling machine, passes through a throttle valve 12 and is returned to the compressor as part of the refrigerant cycle.

Several plates 4 at the lower end of the sublimation chamber can, if desired, be supplied with steam 13 to drive residual moisture from the material to be treated. Relatively little heat is introduced into the system by the use of a few steam-heated heating plates 4 at the lower end of the system.

A vacuum pump 14 operates continuously or discontinuously to maintain the vacuum in the sublimation chamber 3.

If the vaporization temperature of the ice condenser 6, depending upon the material to be treated, is for example minus 60° C. and the condensation temperature of the refrigerant 9 in the heating plates 4 is about minus 10° C., the heat pump maintains a temperature gradient of about 50° C.

By comparison to conventional operating techniques in which the heating plates are steam-heated and the ice condenser is in a refrigerant cycle, the cold costs are significantly reduced. To remove the ice 7 from the ice condensers 6, momentaneous current flow is supplied by the sources 15.

Figure 2:
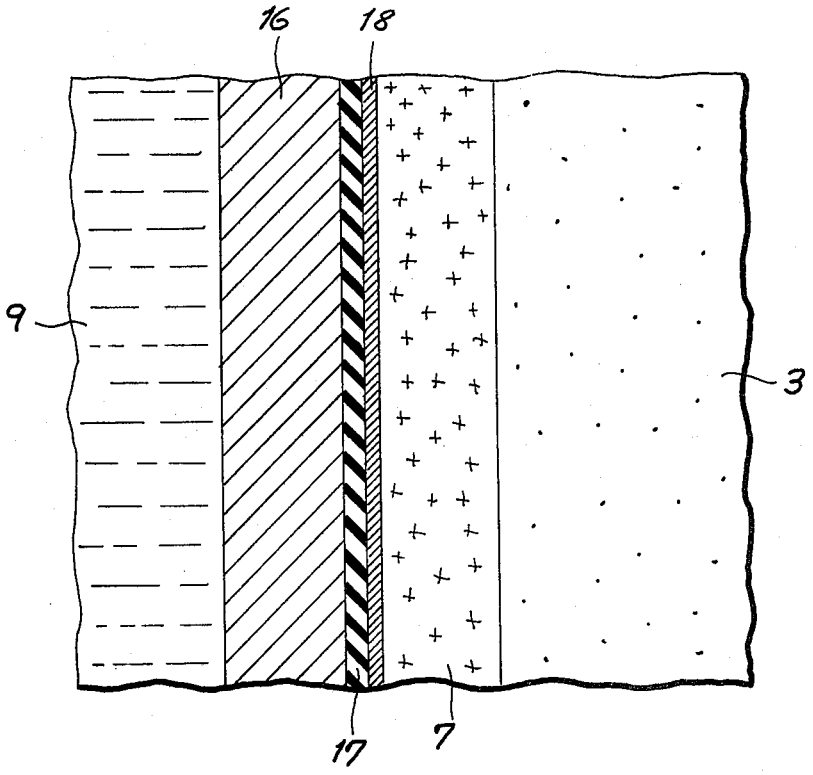
FIG. 2 is an enlarged detail view of a section through the wall of the ice condenser according to the invention.

FIG. 2 show an advantageous construction of the ice-collecting wall of the ice condenser 6 in an enlarged cross sectional view.

The coolant 9 is passed continuously at the temperature necessary for ice formation through the ice condenser 6 and thus is in contact with one side of the supporting wall 16 of the ice condenser. The wall 16, advantageously composed of steel, can be coated with a thin layer 17 of electrically insulating material and with a heating layer 18 of an electrically conducted material and through which an electric current can be passed without current flow through the supporting wall 16. The electrically conductive heating layer 18 can be, for example, a thin metallic layer, vapor or galvanically deposited upon the insulating layer, a thin metal foil, a thin wire screen, or any other electrically conductive material.

The ice can deposit directly upon the heating layer 18 or upon a protective layer which can be applied thereto.

The protective layer can be of a low friction material, e.g. a polytetrafluoroethylene. It will be apparent that the temperature gradient between the sublimation chamber 3 and the heating layer 18, when an electric current is not passed through the latter, can be approximately equal to the temperature between the interior of the sublimation chamber and the coolant 9 in the ice condenser.

A brief current flow through the electrically conductive heating layer 18 results in a reduction of the interfacial portion of the ice layer in contact with the heating layer, below its melting point and thereby causes the ice layer to break loose from the condensers 6 and deposit in the gates 8 by which the ice is led from the sublimation chamber.

It is important, of course, that the heating layer 18, relative to the supporting wall 16, and the insulating layer, are relatively thin. Because of the thermal inertia of the system, the brief heating period does not materially raise the temperature of the supporting wall or transfer significant heat thereto so that the coolant 9 picks up only a minimal amount of heat in the heat exchanger, and can be continuously circulated therethrough.

Advantageously, not all of the ice layers are released from the ice condenser surfaces simultaneously. According to the invention, the surfaces may be heated successively to remove the ice therefrom individually. Advantageously, moreover, the vacuum pump 14 is connected to the sublimation chamber at different locations so that the various inlets can be closed, e.g. by flaps or valves, when the ice is removed from a proximal surface. In this manner it can be guaranteed that there is always a cooled fully effective ice condenser surface between the inlet to the vacuum pump 14 and the path of the material to be freeze-dried through the sublimation chamber.

The system described immediately above the numerous advantages.

Firstly, the ice condenser 6 can be driven quasicontinuously to deposit ice thereon.

Secondly a minimum amount of energy is required for releasing the ice layers 7 from the ice condensers and the amount of such energy is substantially lower than the energy required in conventional systems.

Thirdly, the ice layers can be maintained relatively thins so that the insulating effects of the ice layers are reduced and a higher refrigerant temperature and lower energy cost can be characteristic of the system.

Fourthly, since thin ice layers are periodically removed, there is only a minimum fluctuation in the level of the vacuum in the sublimation chamber. This variation is significantly less than is characteristic of systems in which thick ice layers are removed.

Since the ice condensers 6 need not be removed periodically from the vacuum chamber or need not be fully thawed to melt all of the ice layers thereon, they can be provided relatively close to the freeze dried material and thus long flow paths and high pressure drops are avoided.

By comparison to conventional freeze-dryer arrangements, the ice condensers can be provided directly in the sublimation chamber without closure devices designed to separate the ice condensers from the goods in the sublimation chamber.

It is important, in this connection, to insure that the heating plates 4 do not significantly radiate heat to the ice condensers. This can be achieved as illustrated in the drawing by providing the heating plates in a horizontal orientation while the ice condensers lie vertically and extend the full length of the path of the goods to be freeze dried in the chamber.

The released ice 7 can be removed by vibration through the gate 8 from the vacuum chamber and can be used as the cold source for other stages of the same process or a different process.

Finally, it may be noted that the system of the present invention can be operated continuously or discontinuously and that the present technique for the removal for the recirculation of the sublimation heat can be used in conventional freeze drier arrangements as well. The method in which the material to be treated is transported through the system can be varied and any conventional techniques can be used. For example, the material can be transported in shells by vibration or by agitating devices.

We claim:

1. A freeze drier comprising housing means forming a sublimation chamber; at least one heating plate in said sublimation chamber for heating a material to be freeze-dried therein; at least one ice condenser in said sublimation chamber; means for evacuating said sublimation chamber; and a hat pump for recovering heat from said ice condenser and recirculating same to said heating place, said ice condenser being provided with means for releasing deposited ice therefrom, the means for releasing ice from said ice condenser comprising a heating layer carried by said ice condenser and briefly heatable to release the ice therefrom.

2. The freeze drier defined in claim 1 wherein said heat pump, said heating plate, and said ice condenser form a refrigerant cycle, said refrigerant cycle comprising a compressor, an absorption cooling machine, a cold heat exchanger and a warm heat exchanger, said ice condenser constituting said cold heat exchanger, said heating plate constituting said warm heat exchanger, and means being provided for interconnecting said heat exchangers and said compressor to supply liquefied refrigerant to said ice condenser for evaporation therein, to carry evaporated compressed refrigerant from said compressor to said heating plate, and for feeding a portion of the compressed refrigerant to said absorption cooling machine and returning liquefied refrigerant therefrom to the remainder of said cycle.

3. The freeze dryer defined in claim 1, further comprising anelectrically insulating layer between said heating layer and said ice condenser.

4. The freeze dryer defined in claim 3, wherein said heating layer is a metal foil.

5. The freeze dryer defined in claim 3 wherein said heating layer is a vapor deposited metal layer on said insulating layer.

6. The freeze dryer defined in claim 3 wherein said heating layer is a galvanically deposited metal layer upon said insulating layer.

* * * * *